United States Patent [19]

Kanto

[11] 4,292,565

[45] Sep. 29, 1981

[54] SHADOW MASK ASSEMBLY FOR A CATHODE RAY TUBE

[75] Inventor: Masaharu Kanto, Hyogo, Japan

[73] Assignee: Tokyo Shibaura Denki Kabushiki Kaisha, Kawasaki, Japan

[21] Appl. No.: 31,600

[22] Filed: Apr. 19, 1979

[51] Int. Cl.[3] ..... H01J 29/07

[52] U.S. Cl. ..... 313/407

[58] Field of Search ..... 313/402, 407, 408

[56] References Cited

U.S. PATENT DOCUMENTS

| | | | |
|---|---|---|---|
| 2,728,008 | 12/1955 | Burnside | 313/402 |
| 2,826,538 | 3/1958 | Hunter et al. | 313/402 X |
| 3,349,272 | 10/1967 | Bathelt et al. | 313/408 |
| 3,777,203 | 12/1973 | Yamada et al. | 313/402 X |
| 3,885,190 | 5/1975 | Taniguchi et al. | 313/402 |
| 3,935,036 | 1/1976 | Kinsch | 313/402 X |

FOREIGN PATENT DOCUMENTS

| | | | |
|---|---|---|---|
| 2137142 | 8/1973 | Fed. Rep. of Germany | 313/402 |
| 2361599 | 6/1974 | Fed. Rep. of Germany | 313/402 |
| 2421767 | 11/1975 | Fed. Rep. of Germany | 313/402 |
| 50-11176 | 2/1975 | Japan . | |

*Primary Examiner*—Palmer C. Demeo

*Attorney, Agent, or Firm*—Cushman, Darby & Cushman

[57] ABSTRACT

A cathode ray tube in which a shadow mask assembly constituted by a shadow mask and a mask frame is positioned to face a phosphor screen formed on the inner face of a panel at a predetermined distance. The shadow mask and/or the mask frame is plated with a nickel film 0.5 to 3.0 microns thick and is subsequently blackened, thereby preventing a black oxide film from peeling off the shadow mask assembly.

3 Claims, 2 Drawing Figures

SHADOW MASK ASSEMBLY FOR A CATHODE RAY TUBE

BACKGROUND OF THE INVENTION

This invention relates to a cathode ray tube, and particularly to a color cathode ray tube having with an improved frame mask assembly and which is long durable.

Generally a color cathode ray tube comprises a shadow-mask assembly which is constituted by, as shown in FIG. 1, a shadow mask 1 and a mask frame 2. The shadow mask 1 is welded to the mask frame 2. The mask frame 2 is attached to a panel 3 by means of a frame holder (not shown) in such way that the shadow mask 1 is positioned to face a phosphor screen 4 formed on the panel 3 at a predetermined distance. The panel 3 is fused to a funnel 5, and an electron gun assembly 6 is disposed in the funnel 5. The envelope constituted by the panel 3 and the funnel 5 is then evacuated, whereby the cathode ray tube is completed.

Usually, the shadow mask 1 is made of low-carbon steel, and the mask frame 2 of mild steel. The surface of the mask 1 and frame 2 is blackened or oxidized so as to absorb electron rays and to suppress emission of secondary electrons and rusting during the manufacture of the cathode ray tube. A black oxide film, if formed on the mask 1 and frame 2 by blackening treatment, often peels off when the shadow mask assembly receives impact or vibration during the manufacture process of the cathode ray tube, perhaps for the following reason.

X-ray diffractiometry ascertains that such a black oxide film consists of 80 ~60 wt. % of $Fe_2O_3$ and 20 ~40 wt. % of $Fe_3O_4$. Oxidation is generally thought to proceed along with the reaction of $O_2$ with Fe diffusing in the oxide film and reacting the surface thereof. Thus, the farther the oxidation goes, the more pores are formed in the interface portion between the substrate and the oxide film. As a result, there is formed a porous Fe layer which is mechanically very weak. The black oxide film, though considered relatively dense, is porous. Foreign matters such as $H_2O$ and Cl ions, if put on the black oxide film, would therefore quickly reach the interface between the substrate and the black oxide film during a heating process, for example stabilizing process. Consequently, red rust having a little adhesion is formed in the porous Fe layer which is mechanically very weak. Thus, the black oxide film is quite liable to peel off.

If the black oxide film peels off in the above-mentioned manner and is broken into pieces, the pieces may clog the apertures of the shadow mask, thereby degrading the quality of a color image or reducing the breakdown voltage resistance of the cathode ray tube.

SUMMARY OF THE INVENTION

It is an object of this invention to provide a cathode ray tube in which an oxide film is prevented from peeling off the shadow mask assembly.

According to this invention, a cathode ray tube is provided which has a shadow mask assembly constituted by a shadow mask and a mask frame and positioned to face a phosphor screen formed on an inner surface of a panel at a predetermined distance, at least one of the shadow mask or mask frame being plated with a nickel film 0.5 to 3.0 microns thick and subsequently oxidized.

DESCRIPTION OF THE PREFERRED EMBODIMENT

Figure 1:
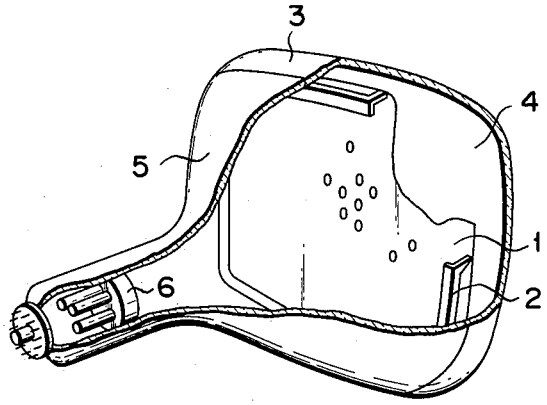
FIG. 1 is a partly broken perspective view of a color cathode ray tube.

This invention is based on the finding that a black oxide film having an extremely large adhesion can be formed if a shadow mask and/or a mask frame is plated with a nickel film and subsequently blackened and that such a black oxide film can hardly peel off if the shadow mask and mask frame receives impact or vibration.

According to this invention, a nickel film plated on a shadow mask and/or a mask frame is 0.5 to 3.0 microns thick, preferably 1.0 to 2.0 microns thick. If the nickel film is less than 0.5 micron thick, any noticeable effect cannot be obtained. If the nickel film is more than 3.0 microns thick, a black oxide film sufficiently thick cannot be formed.

The nickel plating effectively helps form a black oxide film having a large adhesion, perhaps for the following reason.

A shadow mask made of low-carbon steel and nickel-plated is heated to 550° to 600° C. for 5 to 30 minutes in an atmosphere of, for example, a mixture of nitrogen and carbon dioxide or a mixture of steam and air and is therefore blackened. During the blackening process, Fe of the substrate and Ni of the plated film diffuse into each other, thus forming an Fe-Ni diffusion layer. Fe reaching the surface of the Ni film is blackened. Ni is partly oxidized, too. The oxide of Fe and the oxide of Ni therefore constitute a black oxide film. As the blackening goes on, the pores once occupied by Fe are filled with Ni. No pores are therefore formed in an interface portion between the Ni film and the Fe substrate. Even if $H_2O$ or Cl ions stick to the black oxide film and the Fe substrate is eventually oxidized during the subsequent heating process, the topmost black oxide film will never peel off the substrate owing to the Fe-Ni diffusion layer which is rich in Ni. In addition, since it consists chiefly of Fe which has reached the surface of the Ni film during the mutual diffusion of Ni and Fe, the black oxide film is extremely thin. If the black oxide film is scraped by mechanical means, the amount of the scraped oxide film is extremely small.

The Ni film may be formed by the known chemical plating or the known electroplating. All the processes for manufacturing a cathode ray tube, including the blackening process, may be employed in this invention.

Now it will be described how a cathode ray tube is manufactured.

A shadow mask made of low-carbon steel and a mask frame made of mild steel, both having desired shapes, are subjected to electrolysis and oxidation processes. Then, they are plated with a nickel film about 1.0 micron thick by means of electroplating, using a plating solution consisting of 250 g/l of nickel sulfate, 40 g/l of nickel chloride, 40 g/l of boric acid and 5 g/l of cobalt sulfate and an anode made of electrolytic nickel. The plating solution is maintained at 25° to 30° C., and its pH is kept at 4.5 to 5.0. The current density is maintained at 2 to 4 $A/dm^2$. The shadow mask and the mask frame thus plated are then washed with water and then dried. Then, they are heated to 550° to 600° C. for 5 to 30 minutes in an atmosphere consisting of a combustion gas or steam-containing air or in an atmosphere consisting of nitrogen, carbon dioxide and steam and are thus blackened. The blackened shadow mask is welded to the blackened mask frame to form a shadow mask assembly. The shadow mask assembly is attached to a panel, and the panel is fused with a funnel. In this way, a color cathode ray tube not evacuated and without an electron gun assembly is manufactured.

In the above-described manner, 99 color cathode ray tubes without an electron gun assembly were made. The entire outer surface of the panel of each tube was struck with a wood hammer 200 times, applying a force of 200 G. The black oxide film was therefore forcedly broken into pieces, which fell onto a sheet of white paper. The pieces of black oxide film were observed through an optical microscope to see how many pieces were as large as 200 microns or more. On the average, only 0.2 pieces of 200 microns or more was found among those which had fallen from one shadow mask assembly. An optical microscope exposure meter provided with a xenon light source was used to detect the reflection factor of the black oxide film on each shadow mask assembly. It was ascertained that the black oxide films had a relatively low reflection factor of 3%, as compared with that of a mirror which is 100%. The reflection factor is reversely proportional to the thickness of the black oxide film.

(Pieces of 200 microns or more are most likely to clog the apertures of the shadow mask.)

Many other color cathode ray tubes were made in the above-described manner, but provided with shadow mask assemblies plated with nickel films of various thickness other than 1.0 micron. These cathode ray tubes, of course without an electron gun assembly, were put to the same hammering test as mentioned above. The results were as illustrated in FIG. 2, which the relationship between the thickness of a nickel film and the number of black oxide film pieces fallen off the nickel film and the relationship between the thickness of the nickel film and the reflection factor of the black oxide film.

Figure 2:
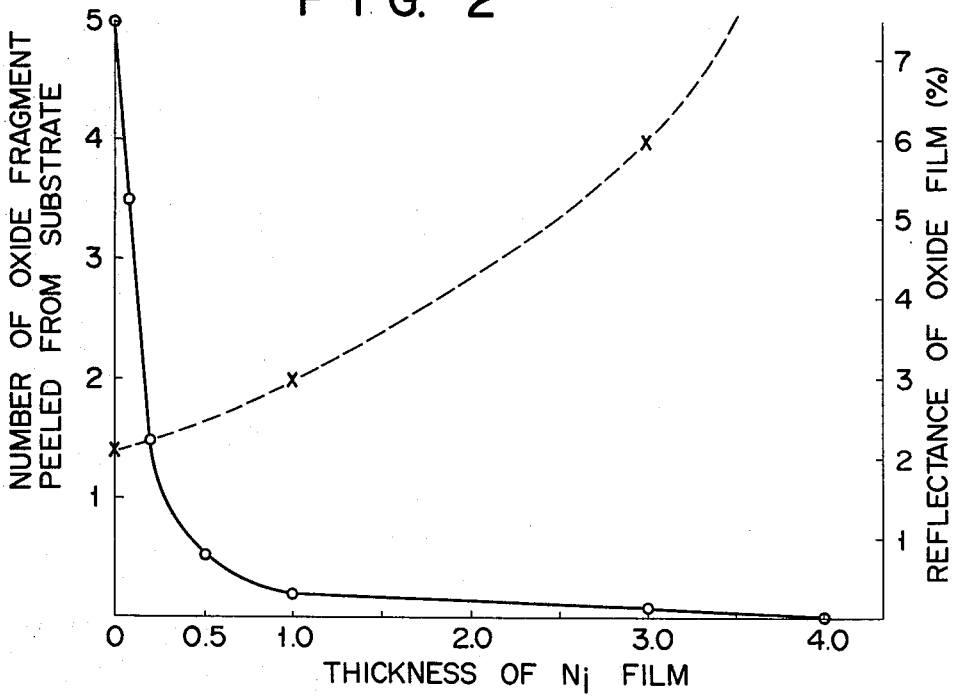
FIG. 2 is a graph showing the relationship between the thickness of a nickel film and the number of black oxide film pieces fallen off the nickel film and the relationship between the thickness of the nickel film and the reflection factor of the black oxide film.

As FIG. 2 clearly shows, only 0.5 piece of black oxide film (200 microns or more) fell per cathode ray tube when the nickel film was 0.5 micron or more thick. When the nickel film was more than 3.0 microns thick, the reflection factor of the black oxide film became too high. When the thickness of the nickel film ranged 1.0 to 2.0 microns, a relatively small number of pieces of black oxide film fell from the shadow mask assembly, and the reflection factor of the black oxide film was relatively low. It is therefore desired that the nickel film be formed 1.0 to 2.0 microns thick.

In the above-described embodiment, both the shadow mask and the mask frame are plated with nickel. Only the shadow mask or only the mask frame may be plated instead, if necessary.

As mentioned above, according to this invention a shadow mask assembly of a cathode ray tube is plated with a nickel film of a predetermined thickness and subsequently blackened. The black oxide film thus formed on the nickel film can hardly peel off. The apertures of the shadow mask is thus scarcely clogged with pieces of black oxide films, whereby the property of the cathode ray tube is rendered more excellent.

What is claimed is:

1. A shadow mask assembly for a cathode ray tube, comprising:

a shadow mask made of steel; and a mask frame made of steel;

at least one of said shadow mask and mask frame having a diffusion layer including nickel and iron and a black oxide layer including mainly iron oxide, the oxide layer being formed on the diffusion layer.

2. A cathode ray tube according to claim 1, wherein said diffusion layer is 1.0 to 2.0 micron thick.

3. A cathode ray tube according to claim 1, wherein said shadow mask is made of low carbon steel, and said mask frame is made of mild steel.

* * * * *